US012145767B2

(12) United States Patent
Martini et al.

(10) Patent No.: US 12,145,767 B2
(45) Date of Patent: Nov. 19, 2024

(54) OPENING DEVICE FOR A PACKAGE ADAPTED TO CONTAIN A POURABLE PRODUCT AND PACKAGE COMPRISING AN OPENING DEVICE

(71) Applicant: TETRA LAVAL HOLDINGS & FINANCE S.A., Pully (CH)

(72) Inventors: Pietro Martini, Parma (IT); Maurizio Filippini, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 335 days.

(21) Appl. No.: 17/052,021

(22) PCT Filed: May 28, 2019

(86) PCT No.: PCT/EP2019/063835
§ 371 (c)(1),
(2) Date: Oct. 30, 2020

(87) PCT Pub. No.: WO2019/238414
PCT Pub. Date: Dec. 19, 2019

(65) Prior Publication Data

US 2021/0163176 A1 Jun. 3, 2021

(30) Foreign Application Priority Data

Jun. 12, 2018 (EP) ..... 18177176

(51) Int. Cl.
*B65D 17/50* (2006.01)
*B65D 5/74* (2006.01)
(Continued)

(52) U.S. Cl.
CPC ..... *B65D 17/507* (2013.01); *B65D 5/749* (2013.01); *B65D 31/04* (2013.01); *B65D 47/12* (2013.01);
(Continued)

(58) Field of Classification Search
CPC ..... B65D 2547/063; B65D 5/749; B65D 75/5894; B65D 2517/0013; B65D 17/507; B65D 47/12
See application file for complete search history.

(56) References Cited

U.S. PATENT DOCUMENTS

| | | | | |
|---|---|---|---|---|
| 3,494,500 | A | 2/1970 | Foster | |
| 2017/0341837 | A1* | 11/2017 | Björk | B65D 65/40 |
| 2018/0029773 | A1* | 2/2018 | Björk | B65D 75/5805 |

FOREIGN PATENT DOCUMENTS

| | | | |
|---|---|---|---|
| EP | 2955122 | B1 | 3/2018 |
| WO | 2015101427 | A1 | 7/2015 |

(Continued)

OTHER PUBLICATIONS

International Search Report (PCT/ISA/210) and Written Opinion (PCT/ISA/237) mailed on Jul. 10, 2019, by the European Patent Office as the International Searching Authority for International Application No. PCT/EP2019/063835.

*Primary Examiner* — Anthony D Stashick
*Assistant Examiner* — Lauren Kmet
(74) *Attorney, Agent, or Firm* — BUCHANAN, INGERSOLL & ROONEY PC

(57) ABSTRACT

An opening device for a package obtained from a sheet of packaging material that comprises at least first and second layers and having a through hole through the first layer and covered by a sheet cover portion of the second layer. The opening device comprises a wall portion applied onto a first side of the sheet cover portion and defining, together with the sheet cover portion, a user-tearable portion of the package; the wall portion comprises a linear weakening slot in a part of the thickness of the wall portion and open at a second surface thereof, opposite the first surface; the linear weakening slot delimits, together with the first side a linear weakening region of the user-tearable portion; the opening
(Continued)

device further comprises at least one pull-member to cause tearing of the user-tearable portion along the linear weakening region, and; at least one projecting linear rib element.

13 Claims, 5 Drawing Sheets

(51) Int. Cl.

| | |
|---|---|
| ***B65D 30/08*** | (2006.01) |
| ***B65D 47/12*** | (2006.01) |
| ***B65D 75/58*** | (2006.01) |
| ***B65D 85/72*** | (2006.01) |

(52) U.S. Cl.
CPC ..... *B65D 75/5894* (2013.01); *B65D 85/72* (2013.01); *B65D 2517/0013* (2013.01); *B65D 2517/5083* (2013.01); *B65D 2547/063* (2013.01); *B65D 2575/58* (2013.01)

(56) References Cited

FOREIGN PATENT DOCUMENTS

| | | | |
|---|---|---|---|
| WO | 2016037818 | A1 | 3/2016 |
| WO | 2016128218 | A1 | 8/2016 |

* cited by examiner

OPENING DEVICE FOR A PACKAGE ADAPTED TO CONTAIN A POURABLE PRODUCT AND PACKAGE COMPRISING AN OPENING DEVICE

TECHNICAL FIELD

The present invention relates to an opening device for a package adapted to contain a pourable product, in particular a pourable food product.

BACKGROUND ART

As it is generally known, many pourable food products, such as fruit juice, UHT (ultra-high temperature-treated) milk, wine, tomato sauce, etc., are sold in packages made of sterilized packaging material.

A typical example is the parallelepiped-shaped package for pourable food products known as Tetra Brik Aseptic (registered trademark), which is made by folding and sealing a laminated sheet of packaging material.

In particular, the packaging material has a multilayer structure substantially comprising a base layer for stiffness and strength, which may be made of fibrous material, e.g. paper or mineral-filled polypropylene material, and a number of lamination layers made of heat-seal plastic material, e.g. polyethylene films, covering both sides of the base layer.

In the case of aseptic packages for long-storage products, such as UHT milk or fruit juice, the packaging material also comprises a layer of gas-barrier material, e.g. aluminum foil or ethyl vinyl alcohol (EVOH) film, which is superimposed on a layer of heat-seal plastic material, and is in turn covered with another layer of heat-seal plastic material. This latter layer of plastic material forms the inner face of the package eventually contacting the pourable food product.

Packages of this sort are normally produced on fully automatic packaging machines, in which a continuous tube is formed from the sheet of packaging material.

Furthermore, the sheet of packaging material is sterilized in the packaging machine by applying a chemical sterilization agent, which is then removed after sterilization is completed.

Subsequently, the sheet of packaging material is maintained in a closed, sterile environment and is folded and sealed longitudinally to form the tube.

In order to complete the forming operations, the tube is filled from above, by means of a pipe, with the pourable food product and is formed, sealed and subsequently cut along equally spaced transversal cross sections.

Pillow packs are obtained thereby, which have a longitudinal sealing band, a top transversal sealing band and a bottom transversal sealing band, and which are then folded mechanically to form respective finished substantially parallelepiped-shaped packages.

To open the packages described above, opening devices made of plastic material have been proposed.

In particular, according to a widespread technology, opening devices are known to be molded, by injection molding, directly on a so-called prelaminated hole, i.e. a hole formed through the base layer only and covered, by means of a lamination process, by the other lamination layers of the packaging material, including the layer of gas-barrier material.

In other words, the molten plastic material is injected onto, and through, a sheet cover portion of the prelaminated hole made of such lamination layers.

According to an alternative solution, such sheet cover portion may be defined by a patch attached to the packaging material to close a hole formed, in this case, through the full thickness of the packaging material.

An example of opening device produced by injection molding is known from EP-B-2955122. In this solution, the molten plastic material is injected onto a first side of the sheet cover portion (i.e. the side of the sheet cover portion eventually facing towards the inner environment of the package) in order to cover such prelaminated hole up to an annular peripheral portion thereof.

In this way, a plastic material confetti portion directly attached to the first side of the sheet cover portion is obtained.

Furthermore, the plastic material confetti portion attached to the first side of the sheet cover portion defines, together with the sheet cover portion itself, a user-tearable portion of the package.

During molding, the plastic material is forced to pierce the sheet cover portion, due to the injection pressure and the geometry of the molding device used to form the opening device, so as to pass through the sheet cover portion, and protrude from a second side of the sheet cover portion, opposite to the first side.

More precisely, the lamination layers forming the sheet cover portion and closing the hole of the base layer are first pierced through and then resealed by the plastic material forming the opening device.

In detail, the plastic material is forced to pierce the sheet cover portion in order to form:

- a pull-member, in the example shown in EP-B-2955122, a pull-ring, protruding from the second side of the sheet cover portion and adapted to be pulled by the user, so as to cause a tearing of the user-tearable portion and causing the package to open; and
- a pouring spout, also protruding from the second side of the sheet cover portion and configured to guide the pourable product exiting from the package, when this latter is emptied under the action of the user.

In the configuration described in EP-B-2955122, the pouring spout is shaped as a threaded cylindrical neck surrounding the sheet cover portion and is adapted to receive a known screw cap, which allows reclosing of the package.

In order to ease the opening of the package, a weakening slot is formed in the plastic material, covered by the sheet cover portion, i.e. by the lamination layers, and delimiting, together with the first side of the sheet cover portion, a weakening region of the user-tearable portion.

In this way, the user can easily pull off, by means of the pull member, the user-tearable portion of the package.

However, though providing a functionally valid method for separating the user-tearable portion from the packaging material and open the package, the known opening devices are still open to further improvement, in particular as to further ease the opening of the package and as to achieve a neat, clean cut tearing and separation of the user-tearable portion.

DISCLOSURE OF INVENTION

It is therefore an object of the present invention to provide an opening device, which is designed to fulfill at least one of the above-mentioned needs in a straightforward and low-cost manner.

It is a further object of the present invention to provide a package, which is designed to fulfill at least one of the above-mentioned needs in a straightforward and low-cost manner.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
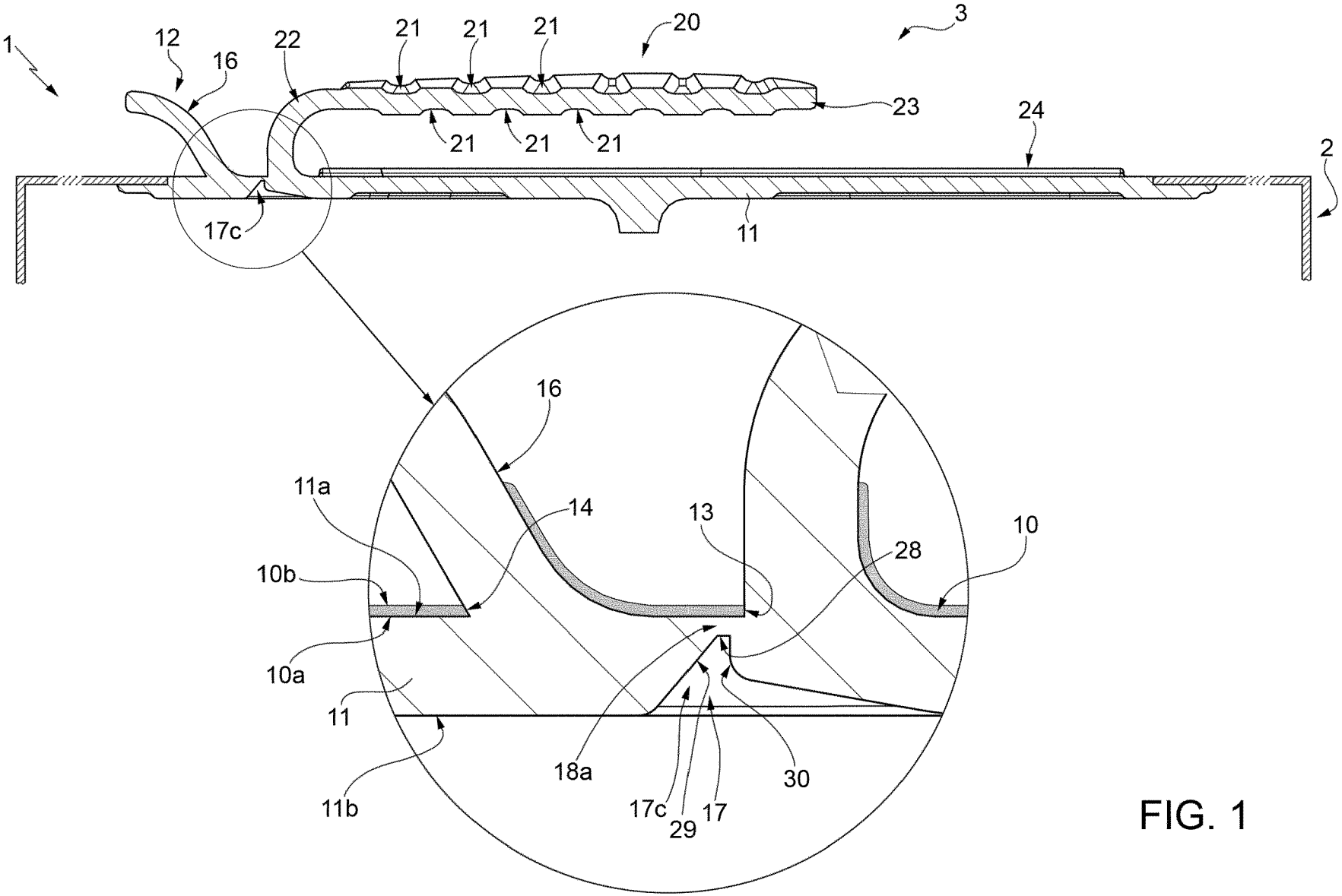
FIG. 1 is a sectional view, with parts removed for clarity, of a package for containing pourable products, made of a sheet of packaging material on which an opening device according to the present invention is molded.

With reference to FIG. 1, number 1 indicates as a whole a package made of a multilayer sheet of packaging material 2, adapted to contain a pourable product, and to which an opening device 3 of plastic material is applied.

In particular, package 1 is adapted to contain a pourable food product, such as milk, water, fruit juice or the like.

In the example shown, opening device 3 is applied to package 1 by molding, preferably by injection molding, plastic material on a specific area of package material 2.

Figure 2:
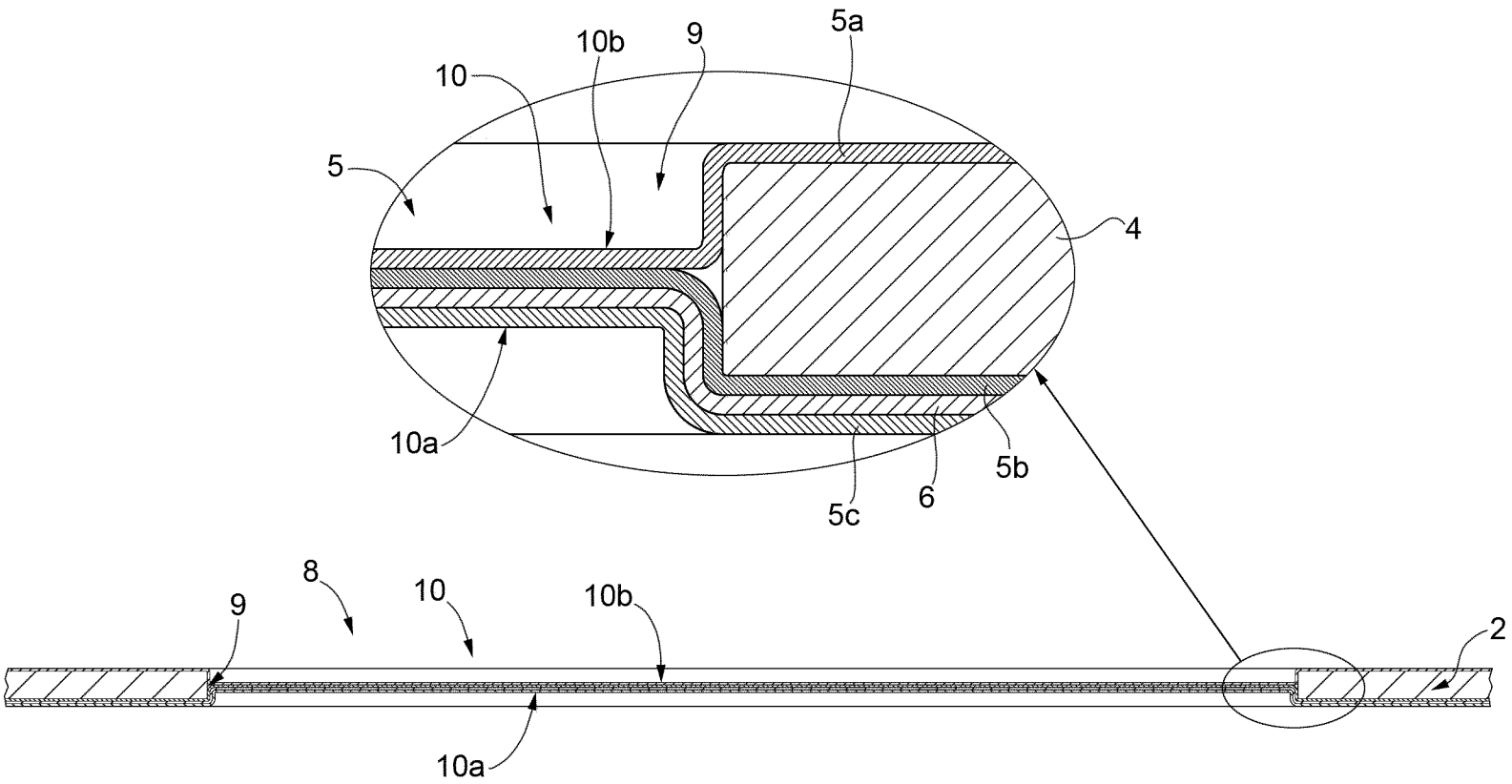
FIG. 2 is a schematic section view of the sheet of packaging material of FIG. 1 before the opening device is molded thereon.

With particular reference to FIG. 2, packaging material 2 comprises a base layer 4 for providing stiffness and strength, which may be made of fibrous material, e.g. paper or mineral-filled polypropylene material, and a cover layer arrangement 5.

In detail, cover layer arrangement 5 comprises a first covering layer 5*a* and a second covering layer 5*b*, both made of heat-seal plastic material, e.g. polyethylene film, and covering both sides of base layer 4.

In the case of an aseptic package 1 for long-storage food products, cover layer arrangement 5 also comprises a barrier layer 6 made of gas-barrier material, e.g. aluminum foil or ethyl vinyl alcohol (EVOH) film, which is superimposed on the second covering layer 5*b* and is in turn covered with a third covering layer 5*c* of cover layer arrangement 5, made of the same heat-seal plastic material of first covering layer 5*a* and second covering layer 5*b*.

In particular, third covering layer 5*c* forms the inner face of package 1 eventually containing the pourable food product.

In other words, first covering layer 5*a*, second covering layer 5*b*, barrier layer 6 and third covering layer 5*c* define lamination layers applied, by a lamination process, to base layer 4 when producing packaging material 2 in the form of a continuous sheet.

Packaging material 2 further comprises a number of removable portions 8 (only one shown in FIG. 2) equally spaced on a lengthwise direction of packaging material 2 and to which respective opening devices 3 are subsequently molded.

In the present description, reference is made to a single opening device 3 molded, by means of a molding device (not shown), on a respective removable portion 8 of packaging material 2, for the sake of simplicity.

According to this non-limiting preferred embodiment shown, removable portion 8 is defined by a so-called prelaminated hole 9, i.e. a through hole formed only through base layer 4 of packaging material 2 and covered by cover layer arrangement 5, i.e. by first covering layer 5*a*, second covering layer 5*b*, barrier layer 6 and third covering layer 5*c*.

In particular, prelaminated hole 9 comprises a sheet cover portion 10 of opening device 3, which is made of the above-mentioned lamination layers and closes the through hole formed in base layer 4.

Preferably, sheet cover portion 10 is an integral part of cover layer arrangement 5.

In an alternative embodiment not shown, sheet cover portion 10 may be made of only one or more of first covering layer 5*a*, second covering layer 5*b*, barrier layer 6 and third covering layer 5*c*. For example, sheet cover portion 10 may be made solely of barrier layer 6.

In another alternative embodiment not shown, sheet cover portion 10 may be defined by a patch attached to packaging material 2 to cover a hole formed, in this case, through the full thickness of packaging material 2.

Figure 3:
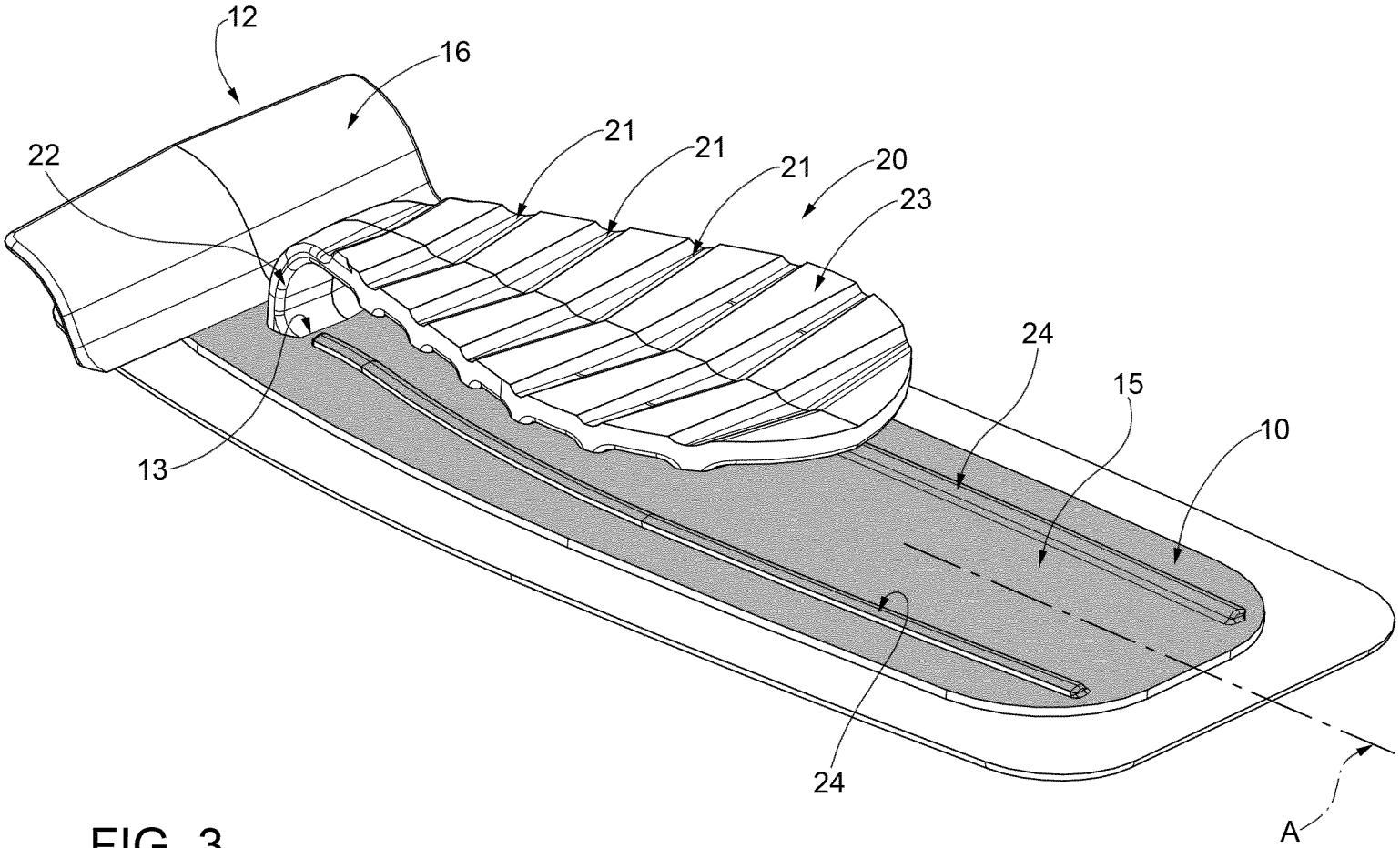
FIG. 3 is a perspective view of the opening device of FIG. 1.
Figure 4:
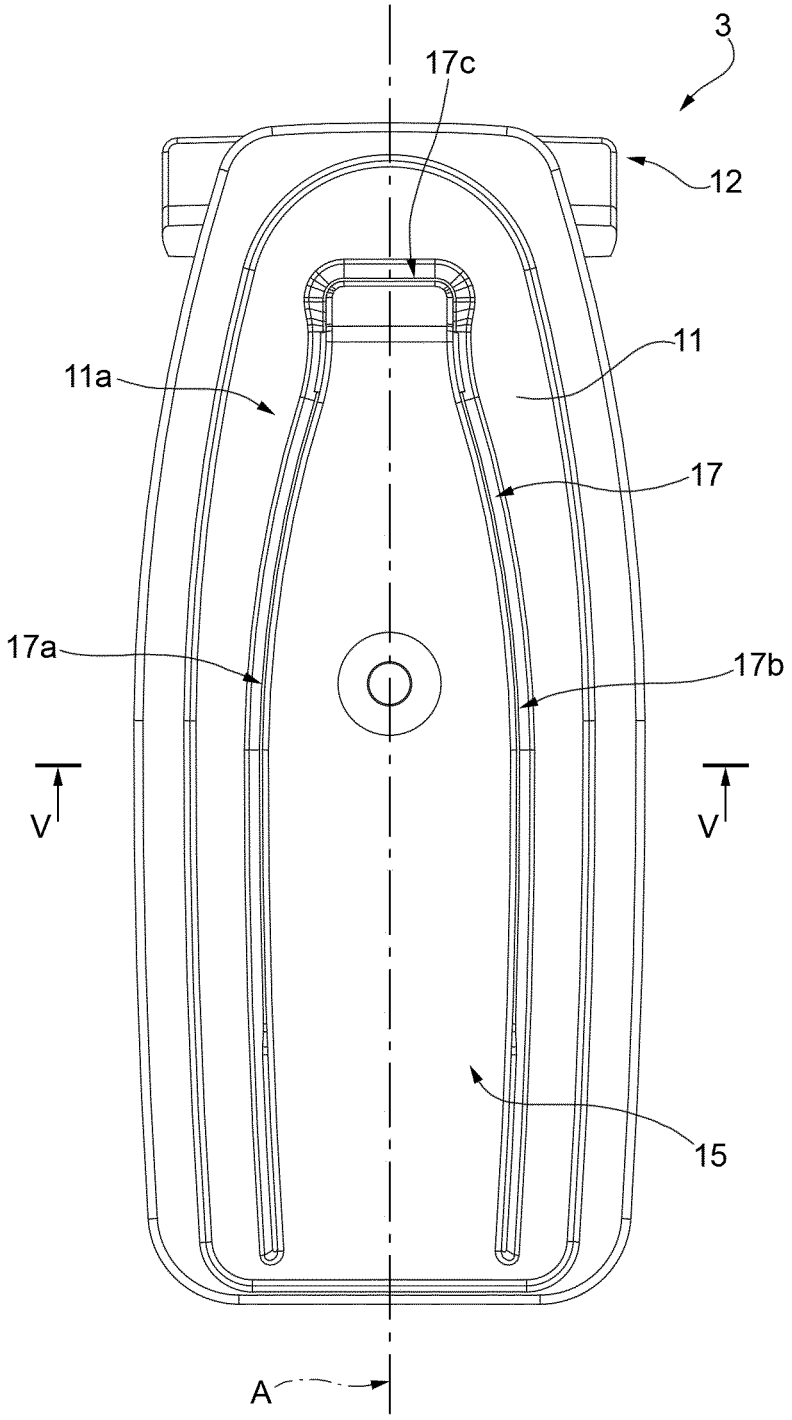
FIG. 4 is a bottom view of the opening device of FIG. 1.

As visible in FIGS. 3 and 4, sheet cover portion 10 has an axis A identifying two parts of sheet cover portion 10.

In the non-limiting example shown, sheet cover portion 10 has a substantially elongated shape and mainly extends along axis A. In this last case, axis A is a longitudinal axis for sheet cover portion 10.

In detail, sheet cover portion 10 has a substantially rectangular shape with differently lengthened short sides and with the long sides parallel to axis A.

Figure 5:
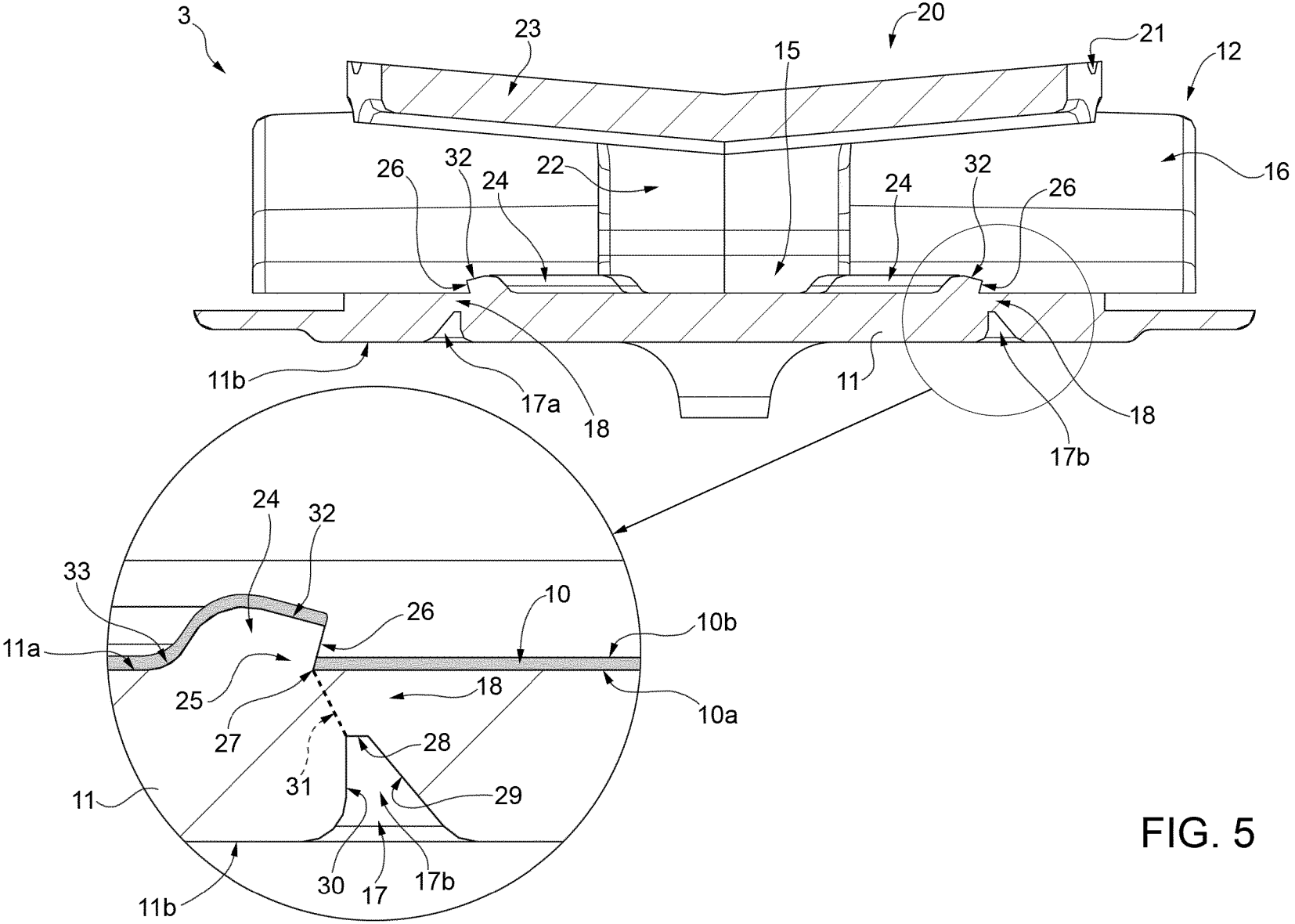
FIG. 5 is a section along line V-V of FIG. 4, with parts removed for clarity.

As shown in FIGS. 1, 4 and 5, opening device 3 further comprises a wall portion 11 having a first surface 11*a* applied, in particular molded, to a first side 10*a* of sheet cover portion 10, i.e., in this preferred embodiment shown, the side eventually facing towards the inner environment of package 1 once package 1 is formed.

In particular, wall portion 11 defines, together with sheet cover portion 10, a user-tearable portion 15 of package 1, configured to be torn by the user, in order to open package 1.

Opening device 3 further comprises a pull-member, in particular a pull tab 20 projecting integrally from first surface 11*a* of wall portion 11, passing through sheet cover portion 10, and protruding from a second side 10*b* of sheet cover portion 10, opposite to first side 10*a*.

More specifically, pull tab 20 and wall portion 11 are integrally formed in one single piece by molding the plastic material on first side 10*a* of sheet cover portion 10, by means of the above-mentioned molding device.

In particular, during molding, the plastic material is forced to pierce sheet cover portion 10, due to the pressure applied by means of the molding device and due to the geometry of the molding device (in a manner known and not described in detail), thereby creating a first pierced area 13, through which pull tab 20 protrudes. In use, pull tab 20 is adapted to be pulled by the user in a direction substantially parallel to axis A, so as to cause tearing of user-tearable portion 15 along the same direction.

In the example shown, pull tab 20 comprises:

- a curved portion 22, projecting transversally from first surface 11*a* of wall portion 11; and
- a straight portion 23, extending from curved portion 22 along a direction substantially parallel to axis A and above sheet cover portion 10, and has a substantially elongated, in particular oval, shape.

In detail, straight portion 23 presents a number of grooves 21 configured to ensure an optimal grip for the user, so as to ease pulling of pull tab 20.

As shown in FIGS. 1, 3, 4 and 5 opening device 3 also comprises a pouring spout 12 projecting integrally from first surface 11*a* of wall portion 11, passing through sheet cover portion 10, and protruding from second side 10*b* of sheet cover portion 10.

In detail, wall portion 11 and pouring spout 12 are molded in one piece and pouring spout 12 is configured to guide the pourable product exiting from package 1, once user-tearable portion 15 is torn by the user.

More specifically, during molding, the plastic material is forced, due to the pressure applied by means of the molding device and due to the geometry of the molding device (in a manner known and not described in detail), to pierce sheet cover portion 10, thereby creating a second pierced area 14 of sheet cover portion 10, through which pouring spout 12 protrudes.

In the example shown, pouring spout 12 is defined by a curved wall 16 projecting transversally from first surface 11*a* of wall portion 11 in a direction opposite to the direction along which straight portion 23 of pull tab 20 extends.

As visible in FIGS. 1, 4 and 5, wall portion 11 comprises a linear weakening slot 17 formed into part of the thickness of wall portion 11 and open at a second surface 11*b* of wall portion 11 opposite to first surface 11*a*.

In detail, as visible in particular in FIG. 4, linear weakening slot 17 is substantially U-shaped and extends within wall portion 11 symmetrically with respect to axis A.

In greater detail, linear weakening slot 17 comprises a first longitudinal portion 17*a* and a second longitudinal portion 17*b*, extending on opposite respective sides of wall portion 11, with respect to axis A, and a third transversal portion 17*c* connecting, at opposite ends thereof, first longitudinal portion 17*a* and second longitudinal portion 17*b*.

More specifically, first longitudinal portion 17*a* and second longitudinal portion 17*b* extend along a direction substantially parallel to axis A; third transversal portion 17*c* extends along a direction substantially transversal to axis A.

In particular, linear weakening slot 17 delimits, together with first surface 11*a* of wall portion 11, a linear weakening region 18, 18*a* of user-tearable portion 15.

More in particular, first longitudinal portion 17*a* and second longitudinal portion 17*b* delimit, together with first surface 11*a*, a linear weakening portion 18 of linear weakening region 18, 18*a* (FIG. 5); third transversal portion 17*c* delimits, together with first surface 11*a*, a further linear weakening portion 18*a* of linear weakening region 18, 18*a* (FIG. 1).

Since linear weakening slot 17 is substantially U-shaped, also linear weakening region 18, 18*a*, being delimited by linear weakening slot 17 and first surface 11*a*, is substantially U-shaped and extends within wall portion 11 substantially along and above linear weakening slot 17.

In detail, linear weakening region 18, 18*a* has a thickness smaller than the total thickness of wall portion 11. In this way, pulling of pull tab 20 will cause, in use, a tearing of user-tearable portion 15 along linear weakening region 18, 18*a*.

In greater detail, further linear weakening portion 18*a* is, in use, the first to tear once pull tab 20 is pulled by the user, along with the part of sheet cover portion 10 directly above further linear weakening portion 18*a*.

According to an important aspect of the present invention, opening device 3 comprises a pair of linear rib elements, in particular a pair of linear ribs 24, projecting integrally from first surface 11*a* of wall portion 11 through sheet cover portion 10, so as to produce respective pierced areas 25, in particular linear pierced areas 25, of sheet cover portion 10.

Furthermore, linear ribs 24 protrude from second side 10*b* of sheet cover portion 10, extend parallel to at least part of linear weakening slot 17, and are configured to promote, in use, tearing of user-tearable portion 15 along linear weakening region 18, 18*a*, in particular along linear weakening portion 18, as better explained in the following.

In detail, linear ribs 24 project integrally from opposite sides of first surface 11*a* of wall portion 11, with respect to axis A.

As visible in FIG. 5, one linear rib 24 extends on first surface 11*a* above and parallel to first longitudinal portion 17*a* of linear weakening slot 17 and the other linear rib 24 extends on first surface 11*a* above and parallel to second longitudinal portion 17*b* of linear weakening slot 17.

According to this preferred embodiment shown, each linear rib 24 comprises a first wall 26 projecting from first surface 11*a* of wall portion 11, protruding transversally from second side 10*b* of sheet cover portion 10, through the respective pierced area 25, and extending on wall portion 11, so as to follow at least part of linear weakening slot 17.

In particular, one first wall 26 extends on first surface 11*a* so as to follow first longitudinal portion 17*a* of linear weakening slot 17, and the other first wall 26 extends on first surface 11*a* so as to follow second longitudinal portion 17*b*.

According to another aspect of the present invention, first wall 26 is at least partially uncovered by sheet cover portion 10 and, therefore, by cover layer arrangement 5.

More precisely, during molding, the plastic material, due to pressure and to the geometry of the molding device, pierces sheet cover portion 10, thereby forming pierced areas 25. During this process, each first wall 26 projects from first surface 11*a*, pre-tearing and lifting up part of sheet cover portion 10. In this way, first wall 26 of each linear rib 24 remains uncovered by sheet cover portion 10, i.e. from cover layer arrangement 5.

As visible in FIG. 5, each first wall 26 has a planar straight shape and delimits, together with first surface 11*a* of wall portion 11, a relative acute angle, thereby defining a respective sharp edge 27.

In detail, each sharp edge 27 extends on first surface 11*a* parallel to at least part of linear weakening slot 17 and is configured to promote, in use, tearing of user-tearable portion 15 along linear weakening portion 18.

In greater detail, one sharp edge 27 extends on first surface 11*a* parallel to first longitudinal portion 17*a* of linear weakening slot 17, and the other sharp edge 27 extends on first surface 11*a* parallel to second longitudinal portion 17*b*.

According to this non-limiting preferred embodiment shown, linear weakening slot 17 has a substantially trapezoidal cross-section and comprises:

- a base surface 28, which is closer to first side 10*a* of sheet cover portion 10 than second surface 11*b* of wall portion 11; and
- a first lateral side 29 and a second lateral side 30, projecting transversally from respective opposite end sides of base surface 28 towards second surface 11*b* of wall portion 11.

In detail, second lateral side 30 is closer to the relative sharp edge 27 than first lateral side 29.

In greater detail, first wall 26 and base surface 28 face one another through sheet cover portion 10, so as to force any possible external gas agent to travel, through wall portion 11, from first wall 26 to base surface 28 along a non-rectilinear path.

In other words, the relative positioning of each linear rib 24 and the respective first longitudinal portion 17*a* or second longitudinal portion 17*b* of linear weakening slot 17 ensures that any possible external gas agent, such as oxygen, has to travel along a labyrinth-shaped path in order to reach linear weakening slot 17 and, thus, the inner environment of package 1.

Base surface 28, first side 10*a* and sharp edge 27 delimit linear weakening portion 18.

In particular, linear weakening portion 18 is configured to tear along a tearing line 31, which extends in use, within wall portion 11, from sharp edge 27 towards base surface 28, transversally with respect to first surface 11*a* of wall portion 11.

Preferably, tearing line 31 extends from sharp edge 27 towards the end side of base surface 28 from which second lateral side 30 of linear weakening slot 17 projects.

In practice, due to the conformation of linear weakening slot 17 and due to the relative positioning of linear weakening slot 17 and linear ribs 24, tearing line 31 is a preferred and guided tearing line for linear weakening portion 18. In this way, a clean tearing of user-tearable portion 15 can be achieved.

As visible in particular in FIG. 5, each linear rib 24 further comprises a respective second wall 32, projecting transversally from the corresponding first wall 26 and extending towards first surface 11*a* of wall portion 11.

In detail, second wall 32 has a curved shape and is smoothly connected to first surface 11*a* by means of a fillet 33.

In particular, fillet 33 provides a smoother connection for second wall 32 with first surface 11*a* than the connection of first wall 26 with first surface 11*a*, i.e. sharp edge 27.

In greater detail, second wall 26 is covered by sheet cover portion 10, i.e. by cover layer arrangement 5.

In use, when pull tab 20 is first pulled by the user, further linear weakening portion 18*a* breaks, thanks to the presence of third transversal portion 17*c* of linear weakening slot 17. Therefore, user-tearable portion 15 begins to separate from package 1.

Then, as the pulling action continues, thanks to the presence of sharp edges 27 and to the relative positioning of these latter and linear weakening slot 17, user-tearable portion 15 continues to tear along linear weakening portion 18. More specifically, linear weakening portion 18 tears along tearing line 31, thereby providing a guided, neat and clean tearing of user-tearable portion 15.

The advantages of opening device 3 according to the present invention will be clear from the foregoing description.

In particular, thanks to the configuration of linear ribs 24, a guided tearing path for tearing of user-tearable portion 15 is provided, i.e. tearing line 31 of linear weakening portion 18. In fact, according to known properties of fracture mechanics, tearing of user detachable portion 15 will begin from sharp edge 27 and not from fillet 33.

Furthermore, thanks to the fact that first walls 26 are uncovered by cover layer arrangement 5, sheet cover portion 10 is already pre-torn when opening of package 1 begins. In this way, only the plastic material of user-tearable portion 15 has to be torn and, therefore, a neat and clean tearing of user-tearable portion 15 can be thereby achieved. Also, any possible stretching of cover layer arrangement 5 during opening is avoided.

In addition, despite first walls 26 are uncovered by cover layer arrangement 5, i.e. from barrier layer 6, and are exposed to external agents, such as oxygen, the particular configuration and relative positioning of linear ribs 24 and linear weakening slot 17 provide a labyrinth-shaped path for such external agents to enter the inner environment of package 1.

Clearly, changes may be made to opening device 3 as described herein without, however, departing from the scope of protection as defined in the accompanying claims.

In particular, linear ribs 24 may be totally uncovered by sheet cover portion 10, i.e. cover layer arrangement 5.

The invention claimed is:

1. A package adapted to contain a pourable product and obtained from a sheet of packaging material; said packaging material comprising at least a first layer and a second layer and having a through hole formed through said first layer; said package comprising said packaging material and an opening device disposed at said through hole, said opening device comprising:

a sheet cover portion of the second layer configured to be arranged at the through hole so as to close the through hole and define a pre-laminated hole;

a wall portion having a top surface applied onto a bottom side of said sheet cover portion;

said wall portion defining, together with said sheet cover portion, a user-tearable portion of said package;

said wall portion comprising a linear weakening slot formed into part of the thickness of said wall portion and open at a bottom surface of said wall portion opposite to said first top surface;

said linear weakening slot delimiting, together with said bottom side of said sheet cover portion, a linear weakening region of said user-tearable portion;

said opening device further comprising at least one pull-member, projecting integrally from said top surface of said wall portion through said sheet cover portion, protruding from a top side of said sheet cover portion, opposite to said bottom side, and adapted to be pulled in use so as to cause tearing of said user-tearable portion along said linear weakening region;

at least one linear rib element, projecting integrally from said top surface of said wall portion through said sheet cover portion, said linear rib element creating a linear pierced area in said sheet cover portion, extending parallel to at least part of said linear weakening slot, and being configured to promote, in use, tearing of said user-tearable portion along at least a linear weakening portion of said linear weakening region.

2. The package as claimed in claim 1, wherein said linear rib element comprises a first wall projecting from said top surface of said wall portion, and extending on said wall portion so as to follow at least part of said linear weakening slot; said first wall being at least partially uncovered by said sheet cover portion.

3. The package as claimed in claim 2, wherein said first wall delimits, together with said top surface of said wall portion, an acute angle, thereby defining a sharp edge; said sharp edge extending on said top surface parallel to at least part of said linear weakening slot and being configured to promote in use tearing of said user-tearable portion along said linear weakening portion.

4. The package as claimed in claim 3, wherein said linear weakening slot has a substantially trapezoidal cross-section and comprises:

a base surface, which is closer to said bottom side of said sheet cover portion than said bottom surface of said wall portion; and a first lateral side and a second lateral side, projecting transversally from respective opposite end sides of said base surface towards said bottom surface of said wall portion;

said base surface, said bottom side and said sharp edge delimiting said linear weakening portion.

5. The package as claimed in claim 4, wherein said first wall and said base surface face one another through said sheet cover portion, so as to force any possible external gas agent to travel, within said wall portion, from said first wall to said base surface along a non-rectilinear path.

6. The package as claimed in claim 4, wherein said linear weakening portion is configured to tear along a tearing line extending in use from said sharp edge towards said base surface, transversally with respect to said top surface of said wall portion.

7. The package as claimed in claim 3, wherein said linear rib element further comprises a second wall, projecting transversally from said first wall, extending towards said top surface of said wall portion and being smoothly connected to said top surface by means of a fillet.

8. The package as claimed in claim 7, wherein said second wall of said linear rib element is covered by said sheet cover portion.

9. The package as claimed in claim 1, wherein said sheet cover portion has an axis (A) identifying two parts of said sheet cover portion; said linear weakening slot comprising a first longitudinal portion and a second longitudinal portion, extending along a direction substantially parallel to said axis (A), on opposite respective sides of said wall portion with respect to said axis (A), and a third transversal portion, extending along a direction transversal to said axis (A) and connecting said first longitudinal portion and said second longitudinal portion.

10. The package as claimed in claim 9, comprising a pair of said linear rib elements, projecting integrally from opposite sides of said first top surface of said wall portion, with respect to said axis (A); one linear rib element of said pair of linear rib elements extending parallel to at least part of said first longitudinal portion and the other linear rib element of said pair of linear rib elements extending parallel to at least part of said second longitudinal portion.

11. The package as claimed in claim 1, wherein said pull-member, said wall portion and said at least one rib element are integrally formed in one single piece by molding a plastic material on said bottom side of said sheet cover portion by means of a molding device.

12. The package as claimed in claim 1, and further comprising at least one pouring spout, projecting integrally from said first top surface of said wall portion through said sheet cover portion, protruding from said top side of said sheet cover portion and configured to guide said pourable product exiting in use from said package, once said user-tearable portion is torn.

13. The package as claimed in claim 1, wherein said sheet cover portion is an integral part of said second layer; said linear rib element being at least partially uncovered by said second layer of said packaging material.

* * * * *